United States Patent [19]

Asdigian

[11] 4,362,614

[45] Dec. 7, 1982

[54] MERCAPTAN EXTRACTION PROCESS WITH RECYCLED ALKALINE SOLUTION

[75] Inventor: George Asdigian, Arlington Heights, Ill.

[73] Assignee: UOP Inc., Des Plaines, Ill.

[21] Appl. No.: 259,296

[22] Filed: Apr. 30, 1981

[51] Int. Cl.[3] ..... C10G 19/02; C10G 19/08

[52] U.S. Cl. ..... 208/235; 208/230

[58] Field of Search ..... 208/235, 230

[56] References Cited

U.S. PATENT DOCUMENTS

| | | | |
|---|---|---|---|
| 1,998,863 | 4/1935 | Chaney et al. | 208/235 |
| 2,428,623 | 10/1947 | Hewlett et al. | 208/235 |
| 2,431,770 | 12/1947 | Payne et al. | 208/235 |
| 2,796,385 | 6/1957 | Phenix, Jr. | 208/235 |
| 2,853,432 | 9/1958 | Gleim et al. | 196/32 |
| 2,921,020 | 1/1960 | Urban et al. | 208/205 |
| 2,921,021 | 1/1960 | Urban et al. | 208/235 |
| 2,988,500 | 6/1961 | Gleim et al. | 208/206 |
| 3,107,213 | 10/1963 | Cole et al. | 208/230 |
| 3,155,606 | 11/1964 | Coe | 208/235 |
| 3,408,287 | 10/1968 | Urban et al. | 208/207 |
| 4,040,947 | 8/1977 | Christman | 208/235 |
| 4,104,155 | 8/1978 | Christman | 208/235 |

FOREIGN PATENT DOCUMENTS

| | | | |
|---|---|---|---|
| 669091 | 3/1952 | United Kingdom | 208/230 |

*Primary Examiner*—Delbert E. Gantz
*Assistant Examiner*—Helane E. Maull
*Attorney, Agent, or Firm*—James R. Hoatson, Jr.; John F. Spears, Jr.; William H. Page, II

[57] ABSTRACT

Water is removed from an alkaline solution used to extract mercaptans from a hydrocarbon stream by contacting the alkaline solution with a warm hydrocarbon vapor stream. The relatively warm and concentrated alkaline solution produced in this manner is then passed into an oxidation zone in admixture with a mercaptan-rich alkaline solution withdrawn from an extraction zone. This process flow has operational and cost advantages compared to the passage of the stripped warm alkaline solution into the extraction zone.

7 Claims, 1 Drawing Figure

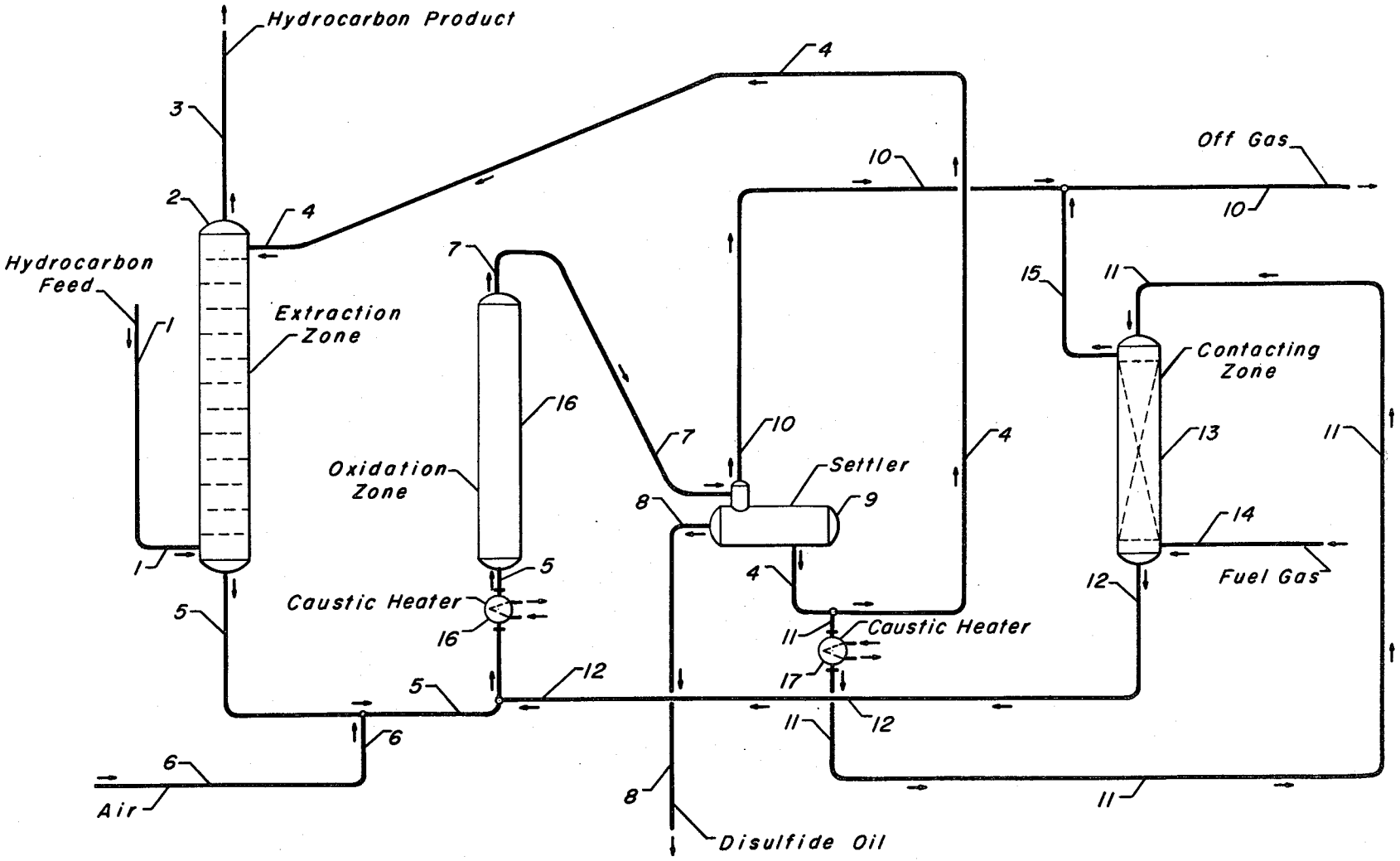
Off Gas
Contacting Zone
Fuel Gas
Caustic Heater
Settler
Disulfide Oil
Hydrocarbon Product
Extraction Zone
Oxidation Zone
Caustic Heater
Hydrocarbon Feed
Air

MERCAPTAN EXTRACTION PROCESS WITH RECYCLED ALKALINE SOLUTION

FIELD OF THE INVENTION

The invention relates to a process for refining mineral oils such as found in Class 208 of the classification system for U.S. Patents. It more specifically relates to a mercaptan extraction process utilizing an alkaline solution to extract the mercaptans from a hydrocarbon stream. The invention is directly concerned with a mercaptan extraction process in which the mercaptan-rich alkaline solution is regenerated by contact with oxygen in a phthalocyanine catalyst.

PRIOR ART

The prior art of mercaptan extraction using an alkaline solution is well developed. Specific examples in which the alkaline solution is regenerated through the oxidation of dissolved mercaptans to disulfide compounds are presented by U.S. Pat. No. 2,853,432 (Cl. 196-32); U.S. Pat. No. 2,921,020 (Cl. 208-205); U.S. Pat. No. 2,988,500 (Cl. 208-206); and U.S. Pat. No. 3,408,287 (Cl. 208-207). These references illustrate the common practices of admixing air with a mercaptan-containing extract stream to support the catalyzed oxidation of the mercaptans, the subsequent passage of the oxidation zone effluent stream into a phase separation zone from which excess air is vented and a regenerated alkaline solution is removed, and the usage of the preferred oxidation catalyst. The references also describe the overall flow of the alkaline stream including the removal of this stream from the phase separation zone and its recirculation to the extraction zone.

The teaching of U.S. Pat. Nos. 4,040,947 and 4,104,155 (Cl. 208-235) is pertinent to the subject inventive concept since these references illustrate the prior art method of handling a warm stripped portion of the alkaline solution. The subject invention is an improvement over the process shown in these two references, with the improvement centering in a change in the flow of the stripped alkaline solution produced in these references.

BRIEF SUMMARY OF THE INVENTION

The invention provides certain cost and operational advantages over the prior art method of extracting mercaptans from hydrocarbons which contain a rather high mercaptan concentration in the entering feed stream. In these processes, the resulting dilution of the aqueous extraction medium is counteracted by the removal of water from this aqueous extraction medium. A relatively warm and concentrated alkaline solution is produced during the preferred water removal method, which comprises contacting a portion of regenerated alkaline solution with a dry gas stream at an elevated temperature. In the subject invention the warm alkaline solution is not passed into the extraction zone as in the prior art, but is instead passed directly into an oxidation zone in which the alkaline solution is regenerated by the oxidation of mercaptans to disulfide compounds. This oxidation zone operates at a higher temperature than the extraction zone, and the passage of the warm alkaline solution into the oxidation zone helps to maintain the desired lower temperature in the extraction zone. It also eliminates any need to cool the warm alkaline solution prior to its passage into the extraction zone thereby eliminating a cooler and its attendant utility costs. Passage of the concentrated alkaline solution into the oxidation zone is also expected to smooth operation of the overall process and to prevent potential disturbances to the operation of the extraction zone which may be caused by changes in the concentration or temperature of the entering alkaline solution.

The invention may be characterized as a process for the removal of mercaptans from a hydrocarbonaceous feed stream which comprises the steps of contacting a feed stream which comprises mercaptans and hydrocarbonaceous compounds with an alkaline solution in an extraction zone maintained at mercaptan extraction conditions to thereby form a treated product stream and a mercaptan-containing alkaline solution; contacting the mercaptan-containing alkaline solution with oxygen and an oxidation catalyst in an oxidation zone to thereby form an oxidation zone effluent stream comprising disulfide compounds in an alkaline solution; separating disulfide compounds from the oxidation zone effluent stream by decantation within a phase separation zone; withdrawing a first liquid stream comprising disulfide compounds from the separation zone; withdrawing a second liquid stream, which is rich in water and comprises the alkaline reagent from the separation zone and passing a first portion of the second liquid stream into the extraction zone as the source of the alkaline solution used therein; removing water from a second portion of the second liquid stream by countercurrent contact with a warm vapor stream comprising $C_5$-minus hydrocarbons; and passing the resultant concentrated second portion of the second liquid stream into the oxidation zone.

DESCRIPTION OF THE DRAWING

The drawing illustrates the preferred embodiment of the invention. This drawing is a simplified outline of the flow of this one embodiment of the invention, and it is not intended to exclude from the scope of the invention other embodiments set out herein or which are the result of normal and expected modifications of this one specific embodiment. Various required subsystems such as pumps, valves, control systems and sensors have been deleted from the drawing for the purposes of simplicity and clarity of presentation.

Referring now to the drawing, a hydrocarbon feed stream comprising hydrocarbonaceous liquid phase compounds and mercaptan compounds enters the process through line 1 and flows into the lower end of an extraction zone 2. The hydrocarbon stream passes upward through the extraction zone countercurrent to an aqueous alkaline stream which enters the top of the extraction zone through line 4. The extraction zone is designed and operated such that the normal liquid-liquid extraction operation between the entering substantially mercaptan-free alkaline stream and the rising hydrocarbonaceous stream causes the transfer of essentially all of the mercaptans in the feed stream to the alkaline stream. This produces a mercaptan-containing alkaline stream which is removed from the extraction zone in line 5 and a treated hydrocarbonaceous stream which leaves the extraction zone as the product stream through line 3.

The mercaptan-containing alkaline stream flowing through line 5 is admixed with a stream of air from line 6 and with a mercaptan-free stream of alkaline solution from line 12. This mercaptan stream is warmed by a small heater 16. The resultant admixture of mercaptan-containing alkaline liquid and air is passed into an oxidation zone 16 wherein there is effected the oxidation of essentially all of the mercaptan compounds which enter the oxidation zone to disulfide compounds. An oxidation zone effluent stream comprising the alkaline solution, the disulfide compounds and the residual components of the air stream from line 6 is removed from the oxidation zone through line 7 and passed into a settler 9 which functions as a phase separation zone. The disulfide compounds separate from the aqueous solution as a separate less dense liquid phase and are withdrawn from the settler as a by-product stream through line 8 for removal from the process.

The gaseous oxygen and nitrogen which enter the settler 9 are removed as a vapor stream through line 10. This oxygen-containing stream is admixed with a hydrocarbon-containing vapor stream from line 15 as a safety precaution and is then passed from the process. A denser liquid phase containing the alkaline solution which enters the settler 9 is removed as a liquid stream through line 4. The majority of this stream continues through line 4 to the extraction zone, with a smaller portion being diverted into line 11 and entering a caustic heater 17. This smaller stream of the aqueous alkaline solution enters the top of the vapor-liquid contacting zone 13 and passes downward through a packed bed of contacting material countercurrent to a rising stream of fuel gas from line 14. The contacting zone is maintained at conditions which cause the transfer of water from the entering liquid to the entering vapor. This removes water from the alkaline solution and increases the concentration of the alkaline material in the solution. The water-enriched fuel gas is removed from the top of the contacting zone through line 15 for admixture with the off gas stream of the settler. The relatively concentrated alkaline solution which is formed within the contacting zone is withdrawn through line 12 and admixed with the mercaptan-containing alkaline solution withdrawn from the extraction zone and then passed directly into the oxidation zone.

DETAILED DESCRIPTION

A large number of mercaptan extraction units are used in petroleum refineries to remove mercaptans from various petroleum streams or products. The purpose of this may be to remove just the mercaptans or as part of an overall reduction in the sulfur content of the petroleum streams. The prevalent method of removing the mercaptans is by extracting them through the use of an aqueous alkaline solution. The mercaptan-containing alkaline solution is then subjected to a procedure referred to as regeneration, which basically consists of oxidizing the mercaptans to disulfides and separating the disulfides from the alkaline solution by decantation.

Water is formed during the regeneration of the alkaline solution. When the mercaptan concentration of the hydrocarbon stream being treated is relatively low, the water formed during regeneration is removed from the process within the residual gases which remain when air is used as the oxygen source during the mercaptan oxidation. However, if the hydrocarbon feed stream has a mercaptan concentration above about 1000 wt. ppm. which is roughly equivalent to a mercaptan sulfur concentration of about 500 wt. ppm. in many refinery streams, then the amount of water formed during regeneration begins to exceed the rate at which it may be conveniently removed from the process in the separation zone off gas stream. The excess water will accumulate and begin to dilute the alkaline solution. This will reduce the effectiveness of the alkaline solution for mercaptan extraction thereby degrading the performance of the process. The previously referred to references, U.S. Pat. Nos. 4,040,947 and 4,104,155, solve this problem of water accumulation in the process through the use of a small contacting zone or water balance column. My invention is directed to an improvement in mercaptan extraction processes of this type and utilizes a similar contacting zone to control the water content of a circulating alkaline solution.

It is an objective of the subject invention to provide a mercaptan extraction process for hydrocarbon streams containing relatively high mercaptan concentrations. It is a further objective of the subject invention to provide an improved mercaptan extraction process in which water is removed from a portion of a circulating alkaline solution in a relatively warm vapor-liquid contacting zone.

The subject extraction process may utilize any alkaline reagent which is capable of extracting mercaptans from the feed stream at practical operating conditions and which may be regenerated in the manner described. A preferred alkaline reagent comprises an aqueous solution of an alkaline metal hydroxide, such as sodium hydroxide or potassium hydroxide. Sodium hydroxide, commonly referred to as caustic, may be used in concentrations of from 1 to 50 wt.%, with a preferred concentration range being from about 5 to about 25 wt.%. Optionally, there may be added an agent to increase the solubility of the mercaptans in the solution, typically methanol or ethanol although others such as phenol, cresol or butyric acid may be used.

Hydrocarbons suitable for mercaptan removal in the extraction zone vary from propane-butane mixtures to middle distillates. Included in this range are streams derived from fluidized catalytic cracking or coking plant gas condensation units, natural or cracked gasolines, jet fuels, fuel oils, kerosenes and blends of these materials including those derived from coal or oil shale. The process may also be used to remove mercaptans from many solvents, alcohols, aldehydes, etc. In general, these materials may be classified as being normally liquid hydrocarbonaceous compounds having boiling points under about 650° F.

The conditions employed in the extraction zone may vary greatly depending on such factors as the nature of the hydrocarbon stream being treated and its mercaptan content, etc. In general, the extraction may be performed at an ambient temperature above about 60° F. and at a pressure sufficient to ensure liquid state operation. With very light material in the feed stream, this may be impractical and the extraction is performed with a vapor phase feed stream. The pressure may range from atmospheric up to 1000 psig. or more, but a pressure in the range of from about 150 psig. to about 350 psig. is preferred.

The temperature in the extraction zone is confined within the range of 50° F. to about 250° F., preferably from 80° F. to 120° F. The ratio of the volume of the alkaline solution required per volume of the feed stream will vary depending on the mercaptan content of the feed stream. Normally this ratio will be between 0.01:1 and 1:1, although other ratios may be desirable. The rate of flow of the alkaline solution will typically be about 2 to 3% of the rate of flow of an LPG stream and may be up to about 20% of a light straight run naphtha stream. The extraction zone is preferably a vertical trayed column having a large number of circular perforations. Optimum extraction in this liquid system is obtained with a velocity through the perforations of from about 5 to about 10 feet per second. A packed column and other types of extraction equipment could be employed if desired. Essentially all of the extractable mercaptans should be transferred to the alkaline solution from the feed stream. As used herein, the term "essentially all" is intended to refer to at least 95% and preferably 98% of all the material referred to.

Proper operation of the extraction zone results in the formation of a mercaptan-containing alkaline stream which is also referred to as a rich alkaline stream or rich caustic stream. This stream is mixed with an air stream supplied at a rate which supplies at least the stoichiometric amount of oxygen necessary to oxidize the mercaptans in the alkaline stream. The air or other oxidizing agent is well admixed with the liquid alkaline stream and the mixed-phase admixture is then passed into the oxidation zone. As already pointed out, the oxidation of the mercaptans is promoted through the presence of a catalytically effective amount of an oxidation catalyst capable of functioning at the conditions found in the oxidizing zone. Several suitable materials are known in the art. Preferred as a catalyst is a metal phthalocyanine such as cobalt phthalocyanine or vanadium phthalocyanine, etc. Higher catalytic activity may be obtained through the use of a polar derivative of the metal phthalocyanine, especially the monosulfo, disulfo, trisulfo, and tetrasulfo derivatives.

The preferred oxidation catalysts may be utilized in a form which is soluble or suspended in the alkaline solution or it may be placed on a solid carrier material. If the catalyst is present in the solution, it is preferably cobalt or vanadium phthalocyanine disulfonate at a concentration of from about 5 to 1000 wt. ppm. Carrier materials should be highly absorptive and capable of withstanding the alkaline environment. Activated charcoals have been found very suitable for this purpose, and either animal or vegetable charcoals may be used. The carrier material is to be suspended in a fixed bed which provides efficient circulation of the alkaline solution. Preferably the metal phthalocyanine compound comprises about 0.1 to 2.0 wt.% of the final composite. More detailed information on liquid-phase catalysts and their usage may be obtained from U.S. Pat. Nos. 2,853,432 and 2,882,224.

Likewise, further information on fixed bed operations is contained in U.S. Pat. Nos. 2,988,500; 3,108,081; and 3,148,156. The oxidation conditions utilized include a pressure of from atmospheric to about 1000 psig., and preferably are substantially the same as used in the downstream phase separation zone. This pressure is normally less than 75 psig. The temperature may range from ambient to about 200° F. when operating near atmospheric pressure and to about 400° F. when operating at superatmospheric pressures. In general, it is preferred that a temperature within the range of about 100° F. to about 175° F. is utilized. The oxidation zone preferably contains a packed bed to ensure intimate mixing. This is done in all cases, including when the catalyst is circulated with the alkaline solution.

The phase separation zone may be of any suitable configuration, with a settler such as represented in the drawing being preferred. Although the disulfide oil phase is shown leaving at the inlet end of this vessel, this phase is normally withdrawn at the other end of the vessel. The phase separation zone is sized to allow the denser alkaline solution to separate by gravity from the disulfide compounds. This may be aided by a coalescing means located in the zone. Normally, a residence time in excess of 90 minutes is provided. A stream of a suitable hydrocarbon, such as a naphtha, is in some instances admixed with the material entering the zone to aid in the separation of the two liquid materials. There is formed in this zone a first liquid phase containing the aqueous alkaline solution and a second liquid phase containing the disulfide compounds. The disulfide compounds and any added hydrocarbons are removed from the process as a byproduct stream, and the aqueous alkaline solution is withdrawn for concentration and reuse.

It is desirable to run the phase separation zone at the minimum pressure which other design considerations will allow. This is to promote the transfer of the excess oxygen, nitrogen and water into the vapor phase. The pressure in the phase separation zone may range from atmospheric to about 300 psig. or more, but a pressure in the range of from about 10 psig. to 50 psig. is preferred. The temperature in this zone is confined within the range of from about 50° F. to about 250° F., and preferably from about 80° F. to 130° F.

The excess oxygen admixed with the alkaline solution results in the presence of unused gaseous oxygen in the phase separation zone. This, along with the nitrogen from the air and some water vapor, is removed as a relatively small vapor stream. The presence of oxygen vapor in any refinery process stream calls for the utmost care in preventing the accidental formation of explosive mixtures by the oxygen-containing stream becoming admixed with hydrocarbons or other combustibles. It is therefore the standard practice to purposely admix this stream with a stream of volatile hydrocarbons having a sufficient flow rate to establish a hydrocarbon concentration above the explosive limit in the resulting mixed gas stream. In this way, any accidental admixture of the separator off-gas stream with hydrocarbons only results in a further enrichment of the stream in hydrocarbons and cannot lead to an explosive mixture. The vapor stream used for this purpose is preferably a fuel gas stream, that is, one which is scheduled for combustion, and the resulting admixture is used as fuel.

Excess water is removed from the alkaline solution by contacting a relatively small portion of the regenerated solution with a vapor stream under conditions which promote the transfer of water into the vapor stream from the alkaline solution. Although other gas streams could be used, it is greatly preferred that the vapor stream used for removing water from the alkaline solution is the same vapor stream which is subsequently admixed with the phase separation zone off gas stream to increase the hydrocarbon content of that stream. The vapor stream used in the contacting step preferably is rich in volatile hydrocarbons, a term used herein to describe hydrocarbons having fewer than six carbon atoms per molecule. Any reference to any stream as being rich in a particular chemical compound or class of compounds is intended to indicate the stream contains at least 55 mole percent and preferably 75 mole percent of the specified chemicals. The relatively small alkaline solution stream and the vapor stream are brought together in a contacting zone which is also referred to as a water balance column. Preferably, the contacting zone comprises a vertical packed column, but the zone may be a tower containing a number of perforated horizontal trays or any other suitable apparatus. The contacting step results in the production of a vapor stream which contains the volatile hydrocarbons or other components of the original vapor stream plus water removed from the small stream of alkaline solution which enters the contacting zone.

The contacting step will normally be conducted at a pressure lower than that present in the phase separation zone. The pressure in the vapor-liquid contacting zone may range up to 1000 psig. but is preferably between about 2 psig. and about 50 psig. The temperature in the contacting zone is to be confined within the range of about 50° F. to about 250° F., and preferably from 100° F. to 200° F. The amount of water removed may be regulated by adjusting the temperature or pressure in the contacting zone or the rate at which the gas stream is passed through the zone. Adjustment of the contacting conditions is the most preferred method since the flow rate of the preferred fuel gas is set by the flow rate of the gas stream leaving the phase separation zone. The volumetric rate of flow of the gas stream required to remove this water is dependent on such factors as the water content of the incoming vapor, the conditions utilized in the contacting zone, the efficiency of the contacting operation and the amount of water to be removed. In general, it is preferred that about 0.001 to about 0.01 mole of gas be passed through the contacting zone for each pound of alkaline solution to be treated therein. A single contacting zone may be used for two or more separate caustic regeneration zones.

The inventive concept may be characterized as a process for the removal of mercaptans from a hydrocarbonaceous feed stream which comprises the steps of contacting a feed stream which comprises mercaptans and hydrocarbonaceous compounds having boiling points below about 650° F. (343° C.) with an alkaline solution comprising water and an alkaline reagent in an extraction zone maintained at mercaptan extraction-promoting conditions to thereby form a treated product stream, which is withdrawn from the extraction zone, and a mercaptan-containing alkaline solution; contacting the mercaptan-containing alkaline solution with oxygen and an oxidation catalyst in an oxidation zone at conditions effective to convert mercaptans to disulfide compounds and to thereby form an oxidation zone effluent stream comprising disulfide compounds in an alkaline solution; separating the disulfide compounds from the oxidation zone effluent stream by decantation in a phase separation zone; withdrawing a first liquid stream, which is rich in disulfide compounds, from the separation zone; withdrawing a second liquid stream, which is rich in water and comprises the alkaline reagent, from the separation zone, and passing at least a first portion of the second liquid stream into the extraction zone as the source of the alkaline solution present in the extraction zone; removing water from a second portion of the second liquid stream by counter current-contact with a vapor stream comprising hydrocarbons having less than 5 carbon atoms per molecule; and passing the second portion of the second liquid stream into the oxidation zone.

To ensure a complete understanding of the practice of the subject invention, the following example is supplied. This example is based on the projected operation of a commercial mercaptan extraction unit and actual operating results may therefore differ from those listed below. The hydrocarbon feed stream is derived from the gas concentration unit of a processing unit which converts residual petroleum fractions to more valuable lighter hydrocarbons. The feed stream is projected to have a flow rate of about 2500 barrels per stream day (BPSD) and contain mainly $C_3$ and $C_4$ hydrocarbons with minor amounts of ethane and isopentane also being present. The feed stream has an average molecular weight of 47.7 and contains about 1500 wt. ppm. of hydrogen sulfide and 8000 wt. ppm. of mercaptan sulfur. This feed stream is passed through an amine extraction unit and a batch type caustic prewash as feed preparation steps designed to limit the entrance of hydrogen sulfide to the subject process. The hydrocarbon feed stream then enters the extraction zone at a pressure of about 208 psig. and a temperature of approximately 100° F. (38° C.). The hydrocarbons pass upward through the extraction zone and are then removed from the process after passing through a caustic settler and sand filter. The lean alkaline solution, generally referred to as caustic, enters the top of the extraction zone at a rate of about 170 BPSD with a specific gravity of 1.153. The rich alkaline solution is removed from the bottom of the extraction zone at a temperature of about 100° F. (38° C.) and is then combined with the rich alkaline solution from two other extraction zones.

The total rich alkaline solution is combined with a stream of warm lean alkaline solution from the contacting zone and is then heated to approximately 120° F. (49° C.) by indirect heat exchange. The heated alkaline solution is combined with an air stream having a flow rate of about 383 lbs/hr and a stream of naphtha having a flow rate near 34 BPSD. The resulting admixture is passed into a fixed bed oxidation zone in which mercaptans present in the alkaline solution are converted to disulfides which become admixed with the naphtha. The mixed phase effluent of the oxidation zone is passed into a phase separation zone. A liquid stream of naphtha and disulfides is removed from the separation zone at the rate of about 58 BPSD.

Approximately 47.4 lbs/hr of water is produced in the process and must be removed to avoid dilution of the alkaline solution. To accomplish this, a portion of the lean alkaline solution, which is withdrawn from the separation zone, is passed into a contacting zone at the rate of about 102 BPSD. This stream is heated to about 150° F. (65° C.) and passed into the top of a packed contacting zone wherein it flows downward countercurrent to a gas stream. This gas stream enters the contacting zone at a pressure of about 5 psig., a temperature near 100° F. (38° C.), a flow rate of about 237 lbs/hr, and has an average molecular weight of about 20. The gas stream leaving the top of the contacting zone should have a flow rate near 629 lbs/hr. This gas stream is combined with an oxygen-containing stream removed from the phase separation zone which comprises the residual components of the air stream passed into the oxidation zone. The alkaline solution leaving the contacting zone should have a specific gravity near 1.158 compared to a specific gravity of about 1.150 as it enters the contacting zone. This warm concentrated alkaline stream has a temperature of about 115° F. (46° C.) and is combined with the rich alkaline solution for passage into the oxidation zone.

I claim as my invention:

1. In a process for the removal of mercaptans from a hydrocarbon stream in which the feed stream is contacted with an alkaline solution comprising water and an alkaline reagent in an extraction zone to effect transfer of mercaptans from the feed stream to the alkaline solution; the resultant mercaptan-containing alkaline solution is contacted with oxygen in an oxidation zone in the presence of an oxidation catalyst to effect oxidation of mercaptans to disulfides; the resultant disulfides are separated from the alkaline solution by decantation; and a portion of the decanted alkaline solution is contacted with a gas stream under conditions which promote transfer of water into the gas stream: the improvement which comprises passing the portion of the alkaline solution which has been contacted with the gas stream directly into the oxidation zone.

2. A process for the removal of mercaptans from a hydrocarbonaceous feed stream which comprises the steps of:

(a) contacting a feed stream which comprises mercaptans and hydrocarbonaceous compounds having boiling points below about 650° F. (343° C.) with an alkaline solution comprising water and an alkaline reagent in an extraction zone maintained at mercaptan extraction-promoting conditions to thereby form a treated product stream, which is withdrawn from the extraction zone, and a mercaptan containing alkaline solution;

(b) contacting said mercaptan-containing alkaline solution with oxygen and an oxidation catalyst in an oxidation zone at conditions effective to convert mercaptans to disulfide compounds and to thereby form an oxidation zone effluent stream comprising disulfide compounds in an alkaline solution;

(c) separating disulfide compounds from the oxidation zone effluent stream by decantation within a phase separation zone;

(d) withdrawing a first liquid stream comprising disulfide components from the separation zone;

(e) withdrawing a second liquid stream, which is rich in water and comprises the alkaline reagent, from the separation zone, and passing at least a first portion of the second liquid stream into the extraction zone as the source of the alkaline solution present in the extraction zone;

(f) removing water from a second portion of the second liquid stream by countercurrent contact with a vapor stream comprising hydrocarbons having less than 5 carbon atoms per molecule; and, (g) then passing the second portion of the second liquid stream directly into the oxidation zone.

3. The process of claim 2 further characterized in that the vapor stream which is contacted with the second portion of the second liquid stream is admixed with an off gas stream comprising oxygen and which is withdrawn from the separation zone.

4. The process of claim 3 further characterized in that the alkaline reagent is an alkali metal hydroxide.

5. The process of claim 4 further characterized in that the oxidation catalyst is a metal phthalocyanine.

6. The process of claim 5 further characterized in that the oxidation catalyst is admixed with the alkaline solution and circulated through the process with the alkaline solution.

7. The process of claim 5 further characterized in that the oxidation catalyst is supported on a fixed bed of solid carrier material located in the oxidation zone.

* * * * *